US008274007B2

(12) United States Patent
Blalock et al.

(10) Patent No.: US 8,274,007 B2
(45) Date of Patent: Sep. 25, 2012

(54) MAGNET INTERRUPTER FOR HIGH VOLTAGE SWITCHING

(75) Inventors: Frank Clay Blalock, Hampton, GA (US); Joseph R. Rostron, McDonough, GA (US); Jeremy Andrew Stone, McDonough, GA (US)

(73) Assignee: Southern States, Inc.

( * ) Notice: Subject to any disclaimer, the term of this patent is extended or adjusted under 35 U.S.C. 154(b) by 159 days.

(21) Appl. No.: 12/859,443

(22) Filed: Aug. 19, 2010

(65) Prior Publication Data

US 2011/0042354 A1 Feb. 24, 2011

Related U.S. Application Data

(60) Provisional application No. 61/235,089, filed on Aug. 19, 2009.

(51) Int. Cl.
*H01H 33/66* (2006.01)

(52) U.S. Cl. ..... 218/129; 218/23

(58) Field of Classification Search ..... 218/23, 218/129

See application file for complete search history.

(56) References Cited

U.S. PATENT DOCUMENTS 4,117,288 A * 9/1978 Gorman et al. ..... 218/129
4,273,977 A * 6/1981 Kii ..... 218/28
4,697,055 A * 9/1987 Walter et al. ..... 218/68
4,900,882 A * 2/1990 Bernard et al. ..... 218/26

* cited by examiner

*Primary Examiner* — Truc Nguyen

(74) *Attorney, Agent, or Firm* — Michael J. Mehrman; Mehrman Law Office

(57) ABSTRACT

A magnetic interrupter consisting of a stationary and moving butt contacts that open an electric circuit in dielectric gas (e.g., $SF_6$) contained in a sealed, pressurized insulating housing. One or both of the contacts contain a magnet with poles spaced apart in a radial plane perpendicular to the axial direction to spin the arc in the radial plane about the center of the contacts. Permanent magnets may be used to spin the arc so that the magnetic field is not affected by the magnitude of the arcing current, which makes the magnetic interrupter suitable for interrupting currents below fault level currents. One or both of the magnets may also be a field coil and a permanent magnet may be used in combination with a field coil.

18 Claims, 6 Drawing Sheets

MAGNET INTERRUPTER FOR HIGH VOLTAGE SWITCHING

REFERENCE TO PRIORITY APPLICATIONS

This application claims priority to commonly-owned U.S. Provisional Patent Application No. 61/235,089, filed Aug. 19, 2009 which is incorporated herein by reference.

REFERENCE TO DISCLOSURES INCORPORATED BY REFERENCE

This application incorporates by reference the disclosures of commonly-owned U.S. Pat. Nos. 7,115,828; 7,078,643; 6,583,978; 6,483,679; 6,316,742 and 6,236,010, which are incorporated herein by reference.

TECHNICAL FIELD

The present invention relates to electric switchgear and, more particularly, relates to a high voltage electric power switch employing one or more ring shaped permanent magnets to spin the arc that develops within a contact gap.

BACKGROUND OF THE INVENTION

High voltage disconnect switches and circuit interrupters are used for a variety of purposes, such as interrupting line, loop, and load currents and switching reactors, capacitors and other circuit devices. Different types of switches are designed to meet different needs. Examples of high voltage circuit interrupters are described in commonly-owned U.S. Pat. Nos. 7,115,828; 7,078,643; 6,583,978; 6,483,679; 6,316,742 and 6,236,010. Disconnect switches and circuit interrupters are designed to switch currents well below fault current levels and operate relatively frequently, such as daily. Circuit breakers, which are used to interrupt much higher fault currents, are typically more expensive and designed to operate much less frequently. The purpose of the present invention is a reliable and cost effective accessory to a high voltage disconnect switch to interrupt line charging, loop splitting and load currents eliminating the need to operate a fault clearing device such as a circuit breaker.

Prior approaches to disconnect switches for these applications include external whips and arcing horns, vacuum bottles, external whips and vacuum bottle in combinations, and puffer type dielectric gas (e.g., $SF_6$) interrupters. Whips and arcing horns, which use exposed air arcing, are suitable only for line charging with line currents limited current to approximately 15 Amps. For vacuum bottles, single bottles are limited to distribution voltages. Multiple bottles in series are required for higher voltages which increases cost and decreases reliability. Because of the increased cost and complex of multi-bottle configurations, linkages are used in order to share a single unit for two and three way switches. In whip and single vacuum bottle combinations, the vacuum bottle interrupts loop switching and the whip interrupts line charging current. Vacuum bottle voltage rating is limited by an optimum contact gap distance which limits the voltage rating to distribution class interrupters. Multiple vacuum bottles in series are required to reach transmission voltage ratings increasing the complexity and cost. Whips and arcing horns are limited in interrupting current since the arcing takes place in air. This can also be a hazard to operating personnel. In general, these configurations are not well suited for interrupting line charging currents and are relatively expensive.

Puffer type dielectric gas interrupters have high operating forces and are the most expensive solution. They are physically larger, heavier, and are not readily adapted to pole mounted transmission switches. They typically have the highest interrupter ratings for interrupter switches.

Spinning arc dielectric gas interrupters have been used as fault current interrupters. In conventional arc spinning dielectric gas interrupters, the magnetic field is generated by directing the current going through the interrupter through field coils to generate the magnetic field to spin the arc. The field coils are typically located in the center of the contacts with opposite poles aligned across the arc gap. In addition, the strength of the magnetic field varies with the current that passes though the interrupter, which generates the magnetic field to spin the arc. These fault current interrupters are typically complex, designed to interrupt high fault current, and are not suited to interrupting lower-level currents, such as line, loop, and load currents because the magnetic flux is a function of the current passing through the coil located in the interrupter.

There is, therefore, a continuing need for a circuit interrupter in which the magnetic flux is at least in part not a function of the current passing through the interrupter to render the interrupter suitable for switching line, loop, and load currents on high voltage transmission lines while eliminating the need to operate a fault clearing device, such as a circuit breaker, to interrupt these types of currents.

SUMMARY OF THE INVENTION

The present invention meets the needs described above in a magnetic circuit interrupter using ring type magnets to rotate the arcing current in a radial plane perpendicular to the axial direction of gap opening. Permanent magnets may be used to spin the arc so that the magnetic field is not affected by the magnitude of the arcing current, which makes the magnetic interrupter suitable for interrupting currents below fault level currents, such as switching line, loop, and load currents on high voltage transmission lines. Testing has shown that this configuration is more successful than cylindrical magnets embedded in the center of the contacts and spaced apart across the arc gap. The actuator for the magnetic circuit interrupter generally requires less robust parts and lower operating energy than vacuum or puffer type interrupters, is readily adapted to transmission voltage levels, and does not produce an arc in air. The size, arrangement, number and polarity of the magnets can be varied to achieve different performance or ratings of interrupter. The housing can be manufactured from any suitable insulating material and can have suitable dimensions to achieve different performance ratings. Different linkage systems may be employed to separate the contacts. This magnetic circuit interrupter can also be used in other configurations, such distribution capacitor bank switches.

More particularly, the invention may be practiced as a magnetic circuit interrupter configured to be electrically connected in an electric power circuit. The interrupter includes a sealed chamber containing a dielectric gas and a contactor located within the chamber having first and second contacts movable in relation to each other during an opening stroke from a closed position in which the contacts are configured to be electrically connected to close the electric power circuit to an open position in which the contacts are configured to be electrically separated to open the electric power circuit. A drive mechanism is operable for moving the first or second contact in an axial direction through the opening stroke to open the electric power circuit. The contacts are configured to form an arc extending generally in the axial direction across an arc gap between the contacts during the opening stroke, the arc cause by an electric current conducting across the contacts.

A first permanent magnet having a first pole having a first polarity and a second pole having a second polarity is carried by the first contact, the first and second poles spaced apart from each other in a radial plane perpendicular to the axial direction. The permanent magnet is generally ring shaped and disposed in the radial plane to generate a magnetic field that imparts a tangential force on the arc in the radial plane to cause the arc to rotate along a generally circular path about the axial direction. The magnetic field is unaffected by the electric current conducting across the contacts.

The first and second contacts typically define opposing faces perpendicular to the axial direction, and the arc rotation remains substantially between the opposing faces during the opening stroke of the interrupter. The permanent magnet may be carried by either contact but is preferably carried by the fixed contact to minimize the weight of the moving contact.

The permanent magnet may be a first permanent magnet with the first and second poles spaced apart from each other in a first radial plane perpendicular to the axial direction. The interrupter may further include a second permanent magnet carried by the second contact having a third pole having the first polarity and a fourth pole having the second polarity, the third and fourth poles spaced apart from each other in a second radial plane perpendicular to the axial direction. The first radial plane is spaced apart from the second first radial plane in the axial direction.

The poles of the first and second permanent magnets may be positioned with poles having like polarity aligned in the axial direction. Alternatively, the poles of the first and second permanent magnets may be positioned with poles having opposite polarity aligned in the axial direction.

The magnetic interrupter may also be practiced with one or more field coils that are disposed with poles spaced apart in a radial plane perpendicular to the axial direction. That is, one or both of the contacts may carry a permanent magnet or a field coil, and a permanent magnet may be used in combination with a field coil.

In view of the foregoing, it will be appreciated that the present invention provides a cost effective magnetic interrupter for high voltage switching. The specific techniques and structures for implementing particular embodiments of the invention, and thereby accomplishing the advantages described above, will become apparent from the following detailed description of the embodiments and the appended drawings and claims.

DETAILED DESCRIPTION OF THE EMBODIMENTS

Figure 1:
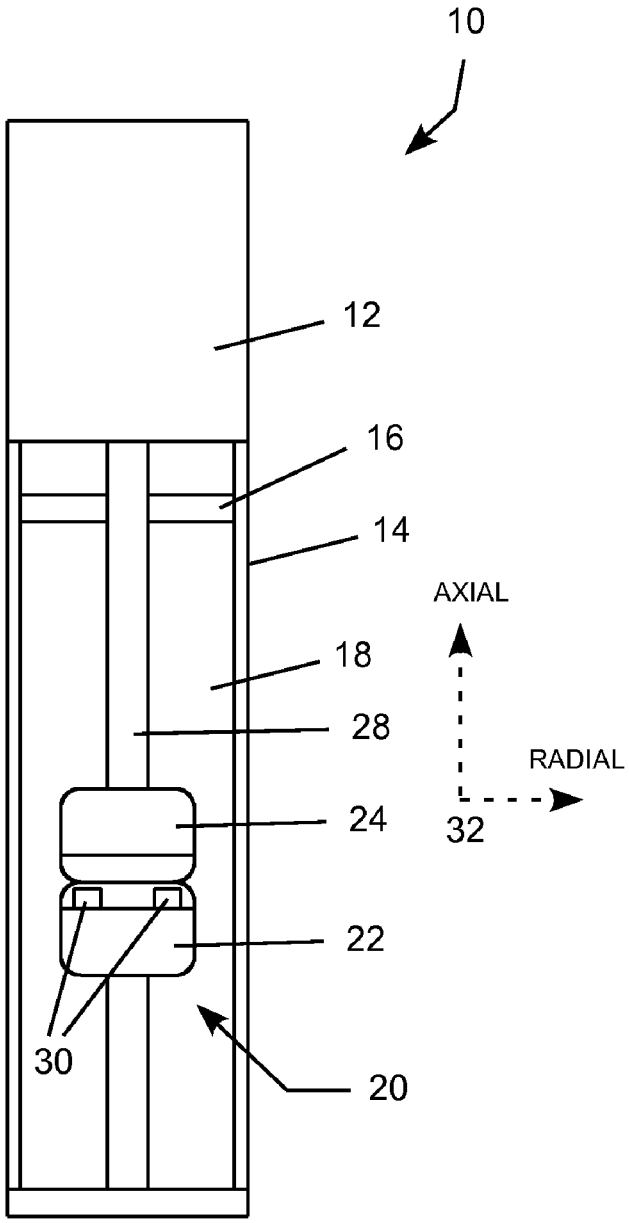
FIG. 1 is a side view of a magnetic interrupter in a closed position.

The present invention may be embodied in a magnetic interrupter consisting of a stationary and moving butt contacts that open an electric circuit in dielectric gas (e.g., $SF_6$) contained in a sealed, pressurized insulating housing. One or both of the contacts contain a magnet with poles spaced apart in a radial plane perpendicular to the axial direction to spin the arc in the radial plane about the center of the contacts. The invention is well suited for arc extinguishing in interrupting disconnect switches rated 72.5 kV and above. The moving contact is connected to a drive mechanism or actuator, such as an over toggle linkage system that locks the contacts in the closed position. When an external lever is moved the linkage collapses and springs move the contact to the open position. A torsion spring returns the external lever to the original position and the contacts close. The arc generated when the contacts open is completely contained in the housing. Vacuum bottles and puffer-type dielectric gas circuit interrupters have similar toggle linkage system but may have more complicated and have more parts.

Permanent magnets rotate the arc through the dielectric gas when the contacts are opened, allowing the arc to cool and extinguish at lower separation speeds when the contacts are opened compared to a puffer type interrupter that compresses and blows gas through the arc gap. In comparison to a puffer type interrupter, the magnetic interrupter requires less energy to operate because the actuator only separates the contacts and does not have to compress gas to extinguish the arc. The magnetic interrupter therefore has less moving mass and typically has fewer parts than a comparable puffer interrupter.

Although conventional interrupters have used bar magnets with poles located on opposing sides of the arc gap, the present invention is believed to be the first magnetic interrupter utilizing ring type a magnet in which the poles are spaced apart from each other in a radial plane that is perpendicular to the axial direction of the arc gap opening. This imparts a tangential force on the arc in the radial plane that causes the arc to rotate along a generally circular path around the center of the contacts. The present invention is also believed to be the first magnetic interrupter utilizing ring type permanent magnets causing the magnetic field in the arc gap to be unaffected by the current flowing through the interrupter while spinning the arc in the radial plane. The present invention is also believed to be the first magnetic interrupter utilizing ring type permanent magnets in combination with ring type field coil magnets that are energized by the current flowing trough the interrupter.

Compared to puffer type interrupters, the magnetic interrupter produces the additional advantage of butt contacts having a relatively large diameter allowing high dielectric strength with small gap and hence short interrupter stroke. This results in low mechanism energy with low operating speeds, typically 1 meter/second as compared to 3-10 meters/second for puffer type interrupters. In addition, the butt contacts operating in a dielectric gas do not have an upper practical voltage limit as do vacuum type interrupters.

It should be noted that the invention may be practiced with permanent magnets located on one or both butt contacts and that a permanent magnet may be used in combination with a field coil that creates a supplemental magnetic field energized by the current flowing through the interrupter. Field coils work for high currents but the arc will stagnate, and melt the contacts, at low currents without the permanent magnet to move arc at low currents. The combination of a field coil and a permanent magnet therefore produces a magnetic interrupter with the advantage of being suitable for use with low currents (e.g., switching line, loop, and load currents) and high currents (e.g., fault) flowing through the interrupter.

Figure 2:
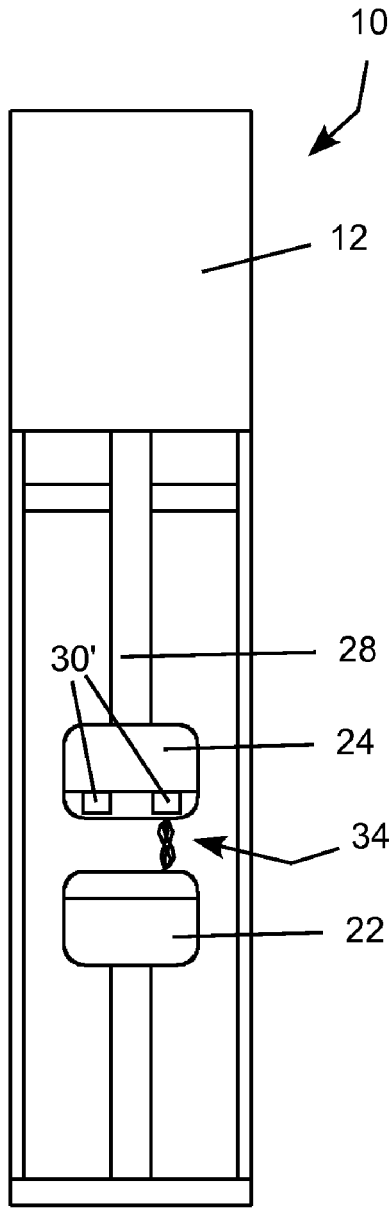
FIG. 2 is a side view of the magnet interrupter in an open position.

Turning now to the figures, FIG. 1 is a side view of the magnetic interrupter 10 in a closed position and FIG. 2 is a side view of the magnetic interrupter 10 in an open position. The magnetic interrupter includes an actuator 12 and a sealed container 14 containing a dielectric gas 18, typically $SF_6$. A gas seal 16 maintains the dielectric gas 18 within the container 14 while the actuator 12 operates a contactor 20 located with the container. The contactor includes a stationary contact 22 and a moving contact 24 that is connected to the actuator 12 by way of a shaft 28. The actuator is operable for reciprocally translating the moving contact 24 in an axial direction between the closed and open positions. The coordinate system 32 illustrates the axial and radial directions for reference. The stationary contact 22 typically carries a ring shaped magnet 30, as shown in FIG. 1. Alternatively or additionally, the moving contact 24 may carry a ring shaped magnet 30'. The ring shaped magnets 30 and 30' distinguish this magnetic interrupter from conventional circuit interrupters.

In a single magnet embodiment, the magnet may be carried on either contact but is typically carried on the stationary contact 22, as shown in FIG. 1, to reduce the weight of the moving contact 24. Nevertheless, the invention may be practiced with the magnet carried by either contact or with magnets carried by both contacts. The magnets 30 and 30' may both be permanent magnets or field coils. It should also be appreciated that one magnet may be a permanent magnet and the other magnet may be a field coil energized by the current flowing through the interrupter.

As in conventional dielectric gas circuit interrupters, the separation of the butt contacts 22, 24 causes the current flowing across the gap to form an arc drawn between the contacts, as shown in FIG. 2. The objective of the interrupter is to extinguish the arc within the design constraints of the device, typically at the first zero-current crossing to avoid a restrike of the current across the arc gap. The presence of the dielectric gas in the arc gap helps to extinguish the arc by absorbing the energy of the arc through ionization of the dielectric gas. In a puffer type interrupter, the dielectric gas is blown into the arc gap to improve the arc extinguishing capacity of the interrupter. The magnetic interrupter takes a different approach by moving the arc through the dielectric gas rather than moving the dielectric gas through the arc gap as in a puffer type interrupter.

As the magnetic interrupter is driven to move the arc through the dielectric gas at the frequency of the electric power flowing through the interrupter, the magnetic interrupter moves the arc through the dielectric gas much faster than a puffer type interrupter can blow the dielectric gas into the arc gap. As a result, the magnetic interrupter exhibits improved arc extinguishing characteristics. This generally translates into slower gap separation speeds and commensurately less complicated and less expensive actuators. The actuator 12 may be any type of actuator suitable for accelerating the moving contact at the desired speed. Illustrative actuators are described in commonly-owned U.S. Pat. Nos. 7,115,828; 7,078,643; 6,583,978; 6,483,679; 6,316,742 and 6,236,010. Those skilled in the art will appreciate how to modify conventional actuators to obtain an actuator with desired properties. While the actuator 12 may be conventional, the size and complexity of the actuator generally increases as the required speed of the contactor separation increases. The magnetic interrupter therefore reduces the size, complexity and cost of the actuator by moving the arc through the dielectric gas at a high speed to cool and extinguish the arc.

Figure 3:
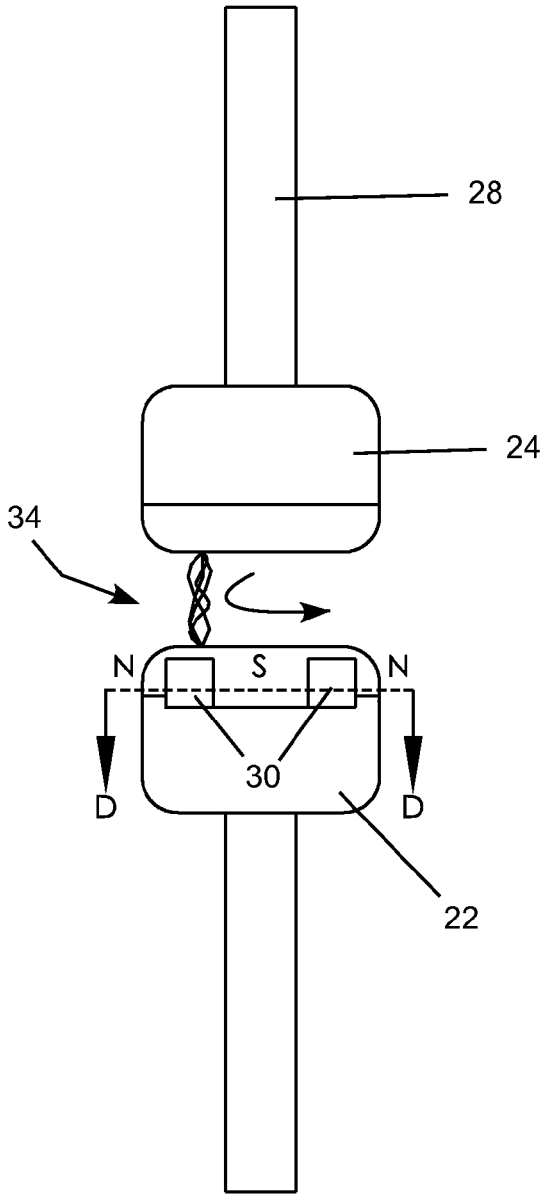
FIG. 3 is a side view of the contactor of the magnetic interrupter having a ring shaped magnet carried by a stationary one of the contacts.
Figure 4:
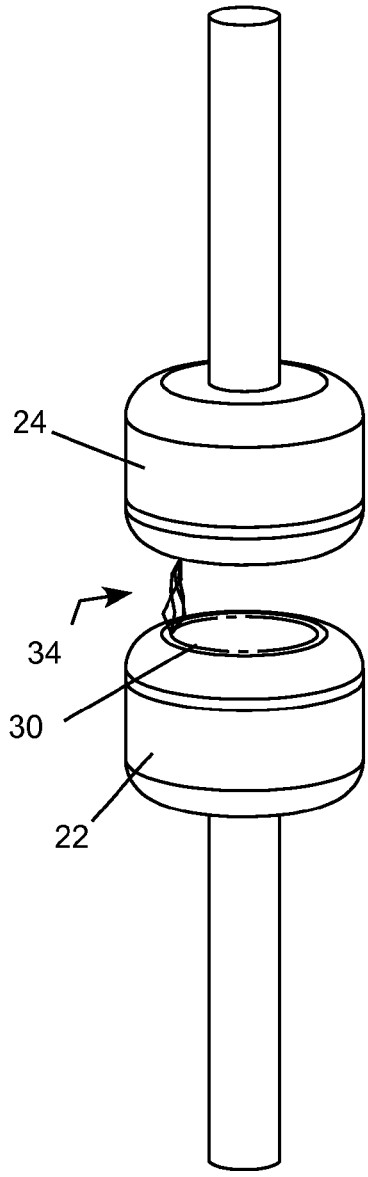
FIG. 4 is a perspective view of the contactor of the magnetic interrupter having a single ring shaped magnet carried by a stationary one of the contacts.
Figure 5:
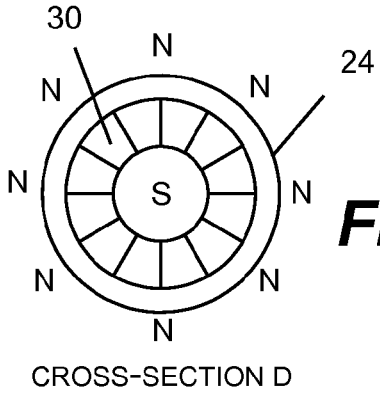
FIG. 5 is a cross-sectional view of a contact for the magnetic interrupter carrying the ring shaped magnet.

FIG. 3 is a side view and FIG. 4 is a perspective view of the contactor 20 of the magnetic interrupter 10. This particular embodiment includes a single ring shaped magnet 30 carried by the stationary contact 22. FIG. 5 is a cross-sectional view of the contact 30 showing the ring shaped magnet 30 in the radial plane. In general, the magnet 30 may have any suitable ring shape in continuous or segmented formation. In particular, the magnet 30 may be formed from a number of wedge shaped segments that fit together to form a toroid, as shown in FIG. 5. The cross-section of the toroid may be square (as shown in FIG. 3), round, oblong, or any other desired shape. The important characteristic of the magnet 30 for the operation of the magnetic interrupter is that it forms magnetic poles (denoted N and S) that are spaced apart from each other in the radial plane, as shown in FIG. 5. This causes the magnet to impart a tangential force on the arc in the radial plane, which rotates the arc in a generally circular path about the center of the contacts. The arc typically makes a partial rotation around the center of the contacts in a forward direction during the positive portion of the current waveform, and an equal partial rotation around the center of the contacts in the reverse direction during the negative portion of the current waveform.

Figure 6:
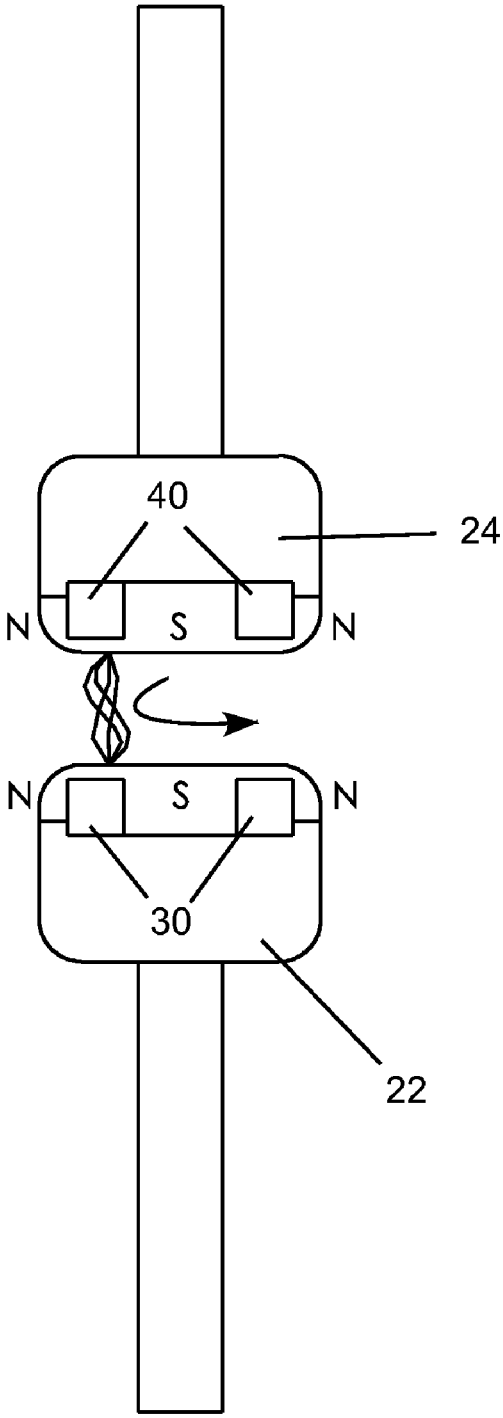
FIG. 6 is a side view of the contactor of the magnet having two ring shaped magnets, one carried by each contact with aligned cross-gap polarity, experiencing desirable facial arcing.
Figure 7:
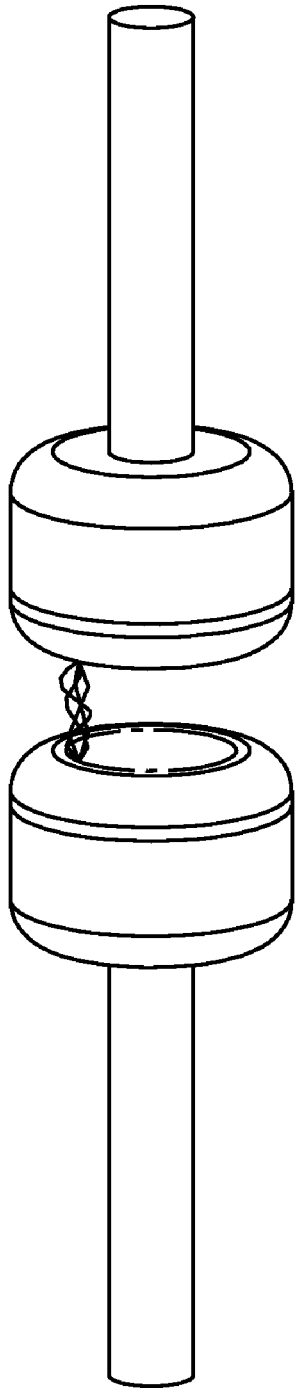
FIG. 7 is a perspective view of the contactor of FIG. 6.

FIG. 6 is a side view and FIG. 7 is a perspective view of the contactor 20 of the magnet having a first ring shaped magnet 30 carried by the stationary contact 22 and a second ring shaped magnet 40 carried by the moving contact 24. This configuration is oriented with aligned cross-gap polarity, in that the like poles are aligned across the arc gap (i.e., N-to-N and S-to-S alignment in the axial direction, or repulsive alignment). The use of magnets with aligned cross-gap polarity can be expected to improve the operation of the contactor by increasing the strength of the magnetic field and providing magnetic repulsion for assist in the opening of the contactors. The expected result is shown in FIGS. 6 and 7, in which the arc remains contained between the opposing faces of the butt contacts.

Figure 8:
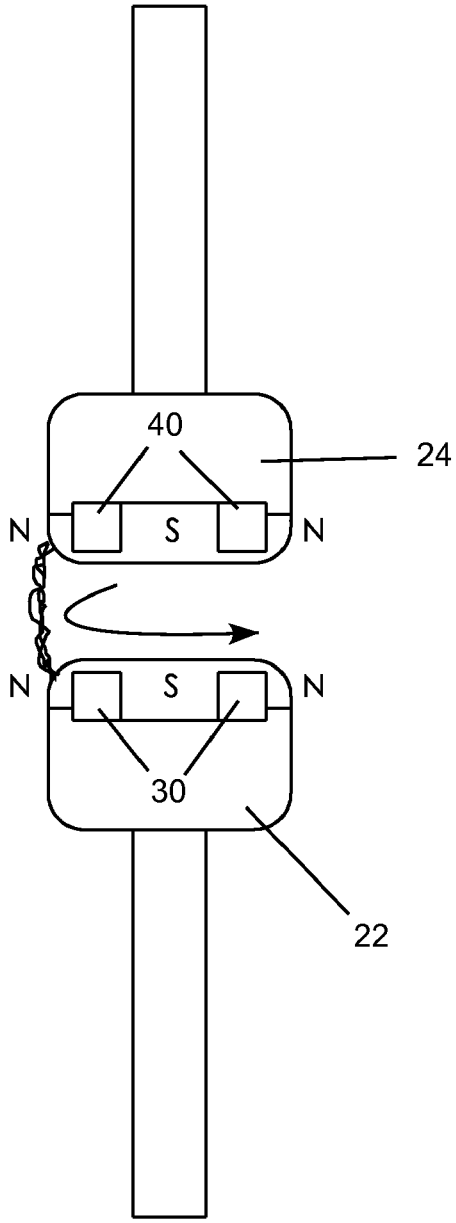
FIG. 8 is a side view of the contactor of FIG. 6 experiencing an undesirable lateral flash over condition.
Figure 9:
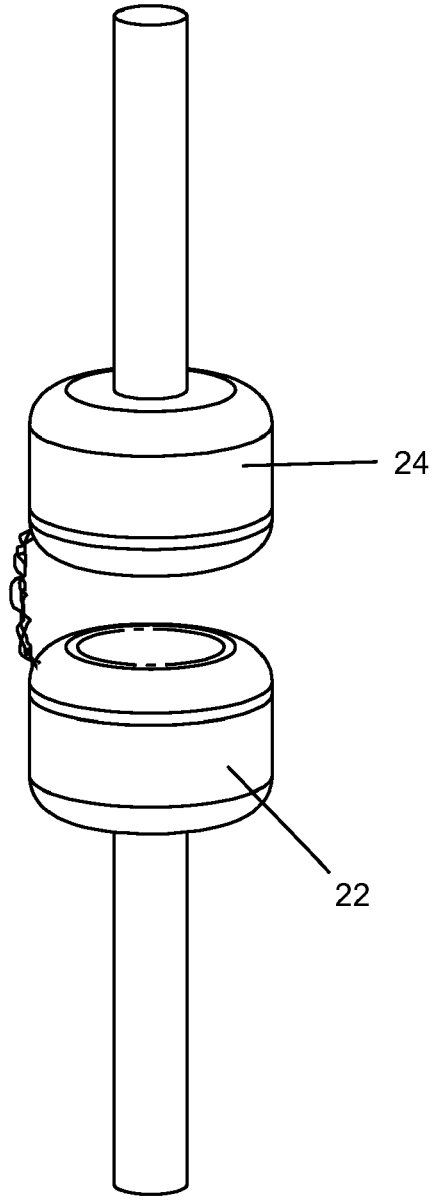
FIG. 9 is a side view of the contactor of FIG. 8.

FIGS. 8 and 9 illustrate an unexpected result experienced in testing, in which the configuration the magnetic interrupter with two magnets having aligned cross-gap polarity has the effect of occasionally causing a lateral flash over, where the arc conducts between the sides of the contacts rather than reliably remaining contained between the opposing faces of the butt contacts. Once the arc begins to flash over in this manner, it can propagate over other surfaces causing damage to the interrupter or other components connected to the circuit.

Figure 10:
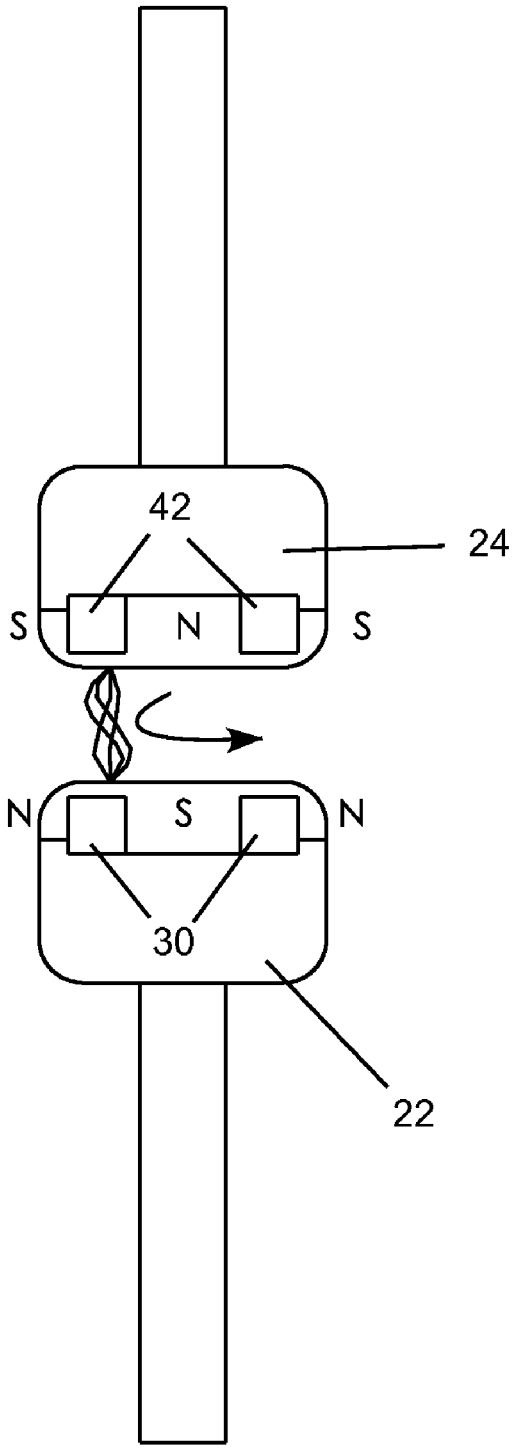
FIG. 10 is a side view of a contactor of the magnetic interrupter having two ring shaped magnets, one carried by each contact with aligned cross-gap polarity, experiencing desirable facial arcing.
Figure 11:
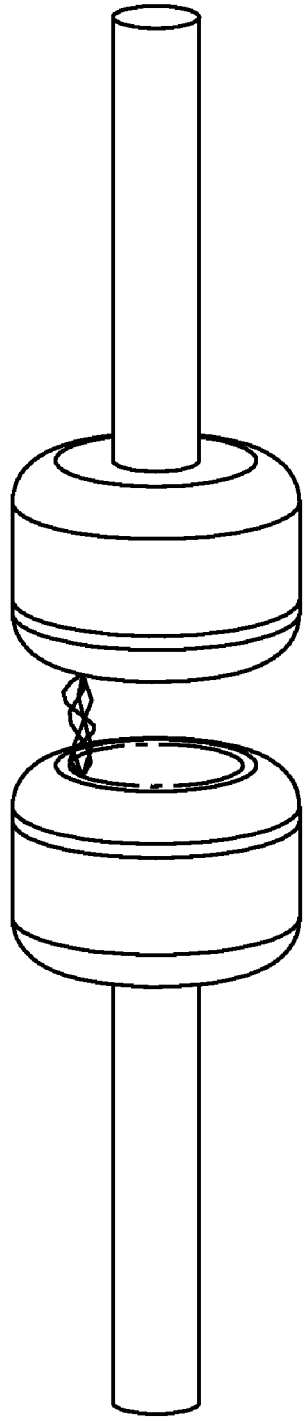
FIG. 11 is a perspective view of the contactor of FIG. 10.

FIG. 10 is a side view and FIG. 11 is a perspective view of the contactor 20 of the magnet having a first ring shaped magnet 30 carried by the stationary contact 22 and a second ring shaped magnet 42 carried by the moving contact 24. This configuration is oriented with reverse cross-gap polarity, in that the opposing poles are aligned across the arc gap (i.e., N-to-S alignment in the axial direction, or attractive alignment). The use of magnets with reverse cross-gap polarity resists the opening of the contactor by increasing the strength of the magnetic field and providing magnetic attraction that resists in the opening of the contactors. Although the basic engineering considerations teach away from this solution, the inventors have discovered that this configuration has the advantage of improving the containment of the arc between the opposing faces of the butt contacts.

Figure 12:
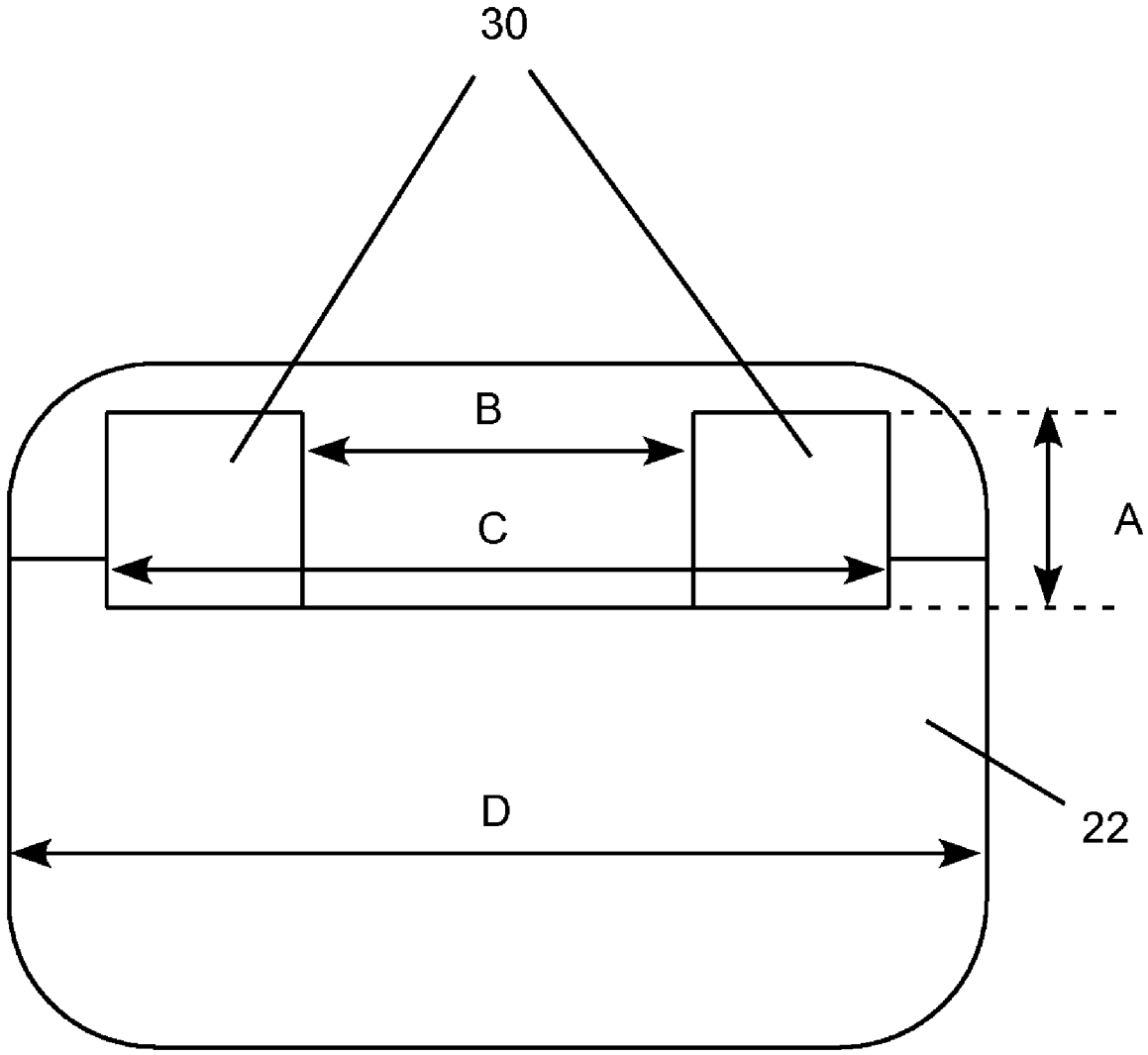
FIG. 12 is a side view of a preferred contactor showing dimensions suitable for a particular operating voltage.

FIG. 12 is a side view of a preferred contactor shown substantially to scale with dimensions suitable for the 72.5 kV operating voltage indicated. The magnet holder portion of the contact 22 may be made from [Copper, Chrome Copper, Copper Tungsten, or other conducting materials] and the permanent magnet may be made from [Neodymium N50]. The dimensions suitable for the 72.5 kV operating voltage are as follows:

A=½"; B=1"; C=2"; D=2½".

In view of the foregoing, it will be appreciated that present invention provides significant improvements in circuit interrupters for distribution and transmission circuits up to high voltage and extra high voltage levels. The foregoing relates only to the exemplary embodiments of the present invention, and that numerous changes may be made therein without departing from the spirit and scope of the invention as defined by the following claims.

The invention claimed is:

1. A circuit interrupter configured to be electrically connected in an electric power circuit; comprising:

a sealed chamber containing a dielectric gas;

a contactor located within the chamber having first and second contacts movable in relation to each other during an opening stroke from a closed position in which the contacts are configured to be electrically connected to close the electric power circuit to an open position in which the contacts are configured to be electrically separated to open the electric power circuit;

an actuator operable for moving the first or second contact in an axial direction through the opening stroke to open the electric power circuit;

the contacts configured to form an arc extending generally in the axial direction across an arc gap between the contacts during the opening stroke, the arc cause by an electric current conducting across the contacts;

a first permanent magnet having a first pole having a first polarity and a second pole having a second polarity carried by the first contact, the first and second poles spaced apart from each other in a radial plane perpendicular to the axial direction;

wherein the permanent magnet is generally ring shaped and disposed in the radial plane to generate a magnetic field that imparts a tangential force on the arc in the radial plane to cause the arc to rotate along a generally circular path about the axial direction;

wherein the magnetic field created by the magnet is unaffected by the electric current conducting across the contacts; and wherein rotation of the arc through the dielectric gas facilitates extinguishing the arc without use of a device to direct a stream of dielectric gas into the arc gap.

2. The circuit interrupter of claim 1, wherein the first and second contacts define opposing faces perpendicular to the axial direction, and the arc rotation remains substantially between the opposing faces during the opening stroke of the interrupter.

3. The circuit interrupter of claim 1, wherein the permanent magnet is a first permanent magnet with the first and second poles spaced apart from each other in a first radial plane perpendicular to the axial direction:

further comprising a second permanent magnet carried by the second contact having a third pole having the first polarity and a fourth pole having the second polarity, the third and fourth poles spaced apart from each other in a second radial plane perpendicular to the axial direction;

wherein the first radial plane is spaced apart from the second radial plane in the axial direction.

4. The circuit interrupter of claim 1, wherein the first and second contacts comprise butt contacts with solid surface opposing faces for conducting the arc.

5. The circuit interrupter of claim 1, further comprising a single non-vented chamber housing the dielectric gas configured to contain the dielectric gas within the chamber during the opening stroke.

6. A circuit interrupter configured to be electrically connected in an electric power circuit; comprising:

a sealed chamber containing a dielectric gas;

a contactor located within the chamber having first and second contacts movable in relation to each other during an opening stroke from a closed position in which the contacts are configured to be electrically connected to close the electric power circuit to an open position in which the contacts are configured to be electrically separated to open the electric power circuit;

an actuator operable for moving the first or second contact in an axial direction through the opening stroke to open the electric power circuit;

the contacts configured to form an arc extending generally in the axial direction across an arc gap between the contacts during the opening stroke, the arc cause by an electric current conducting across the contacts;

a first magnet having a first pole having a first polarity and a second pole having a second polarity carried by the first contact, the first and second poles spaced apart from each other in a radial plane perpendicular to the axial direction;

the first magnet generally ring shaped and disposed in the radial plane to generate a magnetic field that imparts a tangential force on the arc in the radial plane to cause the arc to rotate along a generally circular path about the axial direction;

a second magnet carried by the second contact having a third pole having the first polarity and a fourth pole having the second polarity, the third and fourth poles spaced apart from each other in a second radial plane perpendicular to the axial direction;

the second magnet generally ring shaped and disposed in the second radial plane to generate a magnetic field that imparts a tangential force on the arc in the second radial plane to cause the arc to rotate along the generally circular path about the axial direction;

wherein the first radial plane is spaced apart from the second radial plane in the axial direction; and wherein rotation of the arc through the dielectric gas facilitates extinguishing the arc without use of a device to direct a stream of dielectric gas into the arc gap.

7. The circuit interrupter of claim 2, wherein the permanent magnet is carried by a fixed one of the contacts.

8. The circuit interrupter of claim 2, wherein the permanent magnet is carried by a moving one of the contacts.

9. The circuit interrupter of claim 3, wherein the poles of the first and second permanent magnets are positioned with poles having like polarity aligned in the axial direction.

10. The circuit interrupter of claim 3, wherein the poles of the first and second permanent magnets are positioned with poles having opposite polarity aligned in the axial direction.

11. The circuit interrupter of claim 10, wherein the first and second contacts define opposing faces perpendicular to the axial direction, and the arc rotation remains substantially between the opposing faces during the opening stroke of the interrupter.

12. The circuit interrupter of claim 6, further comprising a single non-vented chamber housing the dielectric gas configured to contain the dielectric gas within the chamber during the opening stroke.

13. The circuit interrupter of claim 12, wherein the poles of the first and second permanent magnets are positioned with poles having opposite polarity aligned in the axial direction.

14. The circuit interrupter of claim 13, wherein the first and second contacts define opposing faces perpendicular to the axial direction, and the arc rotation remains substantially between the opposing faces during the opening stroke of the interrupter.

15. The circuit interrupter of claim 14, wherein the first magnet is a permanent magnet.

16. The circuit interrupter of claim 15, wherein the second magnet is a permanent magnet.

17. The circuit interrupter of claim 13, wherein the second magnet is a field coil magnet.

18. The circuit interrupter of claim 12, wherein the first and second contacts comprise butt contacts with solid surface opposing faces for conducting the arc.

* * * * *